US005779435A

United States Patent [19]

Lageder et al.

[11] Patent Number: 5,779,435

[45] Date of Patent: Jul. 14, 1998

[54] LOW-PRESSURE STEAM TURBINE

[75] Inventors: Heinrich Lageder, Baden; Urs Ritter, Stüsslingen, both of Switzerland

[73] Assignee: Asea Brown Boveri AG, Baden, Switzerland

[21] Appl. No.: 644,461

[22] Filed: May 10, 1996

[30] Foreign Application Priority Data

Jun. 30, 1995 [DE] Germany ..... 195 23 923.7

[51] Int. Cl.[6] ..... F01D 25/26; F01D 25/28; F01K 9/02

[52] U.S. Cl. ..... 415/108; 415/126; 415/176; 415/177; 415/213.1; 415/214.1; 415/215.1; 415/229; 60/692; 184/106; 248/679

[58] Field of Search ..... 415/100, 101, 415/103, 111, 108, 176–179, 112, 229, 213.1, 214.1, 215.1, 220, 126; 184/6, 106; 248/679; 60/692

[56] References Cited

U.S. PATENT DOCUMENTS

| | | | |
|---|---|---|---|
| 3,520,634 | 7/1970 | Bellah et al. | 415/213.1 |
| 3,628,884 | 12/1971 | Mierley, Sr. | 415/213.1 |
| 4,866,941 | 9/1989 | Stock . | |
| 5,094,588 | 3/1992 | Gros . | |
| 5,290,146 | 3/1994 | Erber | 415/213.1 |

FOREIGN PATENT DOCUMENTS

| | | | |
|---|---|---|---|
| 0206135 | 12/1986 | European Pat. Off. . | |
| 0384200 | 8/1990 | European Pat. Off. . | |
| 0575642 | 12/1993 | European Pat. Off. . | |
| 0594499 | 4/1994 | European Pat. Off. . | |
| 1034924 | 7/1958 | Germany | 415/220 |
| 2115900 | 10/1971 | Germany . | |

*Primary Examiner*—Christopher Verdier
*Attorney, Agent, or Firm*—Burns, Doane, Swecker & Mathis, L.L.P.

[57] ABSTRACT

The object of the invention is to increase the efficiency of a low-pressure steam turbine connected to a condenser and to reduce its cost of manufacture.

According to the invention this is achieved when the dividing plane (8) of the top and bottom part (6, 7) of the outer casing (1) of the low-pressure steam turbine lies at the level of the axis (9) of the turbine rotor (4) and the concrete foundation (14) reaches up to the dividing plane (8). Both the bottom part (7) of the outer casing (1) and the bearing points (10) of the turbine rotor (4) are secured in the concrete foundation (14). The outer casing (1) is designed to be open at least on one side at right angles to and horizontally to the axis (9) of the turbine rotor (4). A condenser (16) is attached to each lateral opening (17) in the outer casing (1). The top part (6) of the outer casing (1) consists of an assembly hood (19) and, for each condenser (16), a frame part (20) connected to the latter and the bottom part (7) by retention of self substance or in a non-positive manner. The assembly hood (19) is connected to both the bottom part (7) of the outer casing (1) and each frame part (20) in a non-positive or positive-locking manner, one frame part (20) each being arranged between a condenser (16) and the assembly hood (19).

6 Claims, 3 Drawing Sheets

LOW-PRESSURE STEAM TURBINE

BACKGROUND OF THE INVENTION

1. Field of the Invention

The invention relates to a low-pressure steam turbine connected to a condenser.

2. Background

In multi-stage steam turbines consisting of a high-pressure part, an intermediate-pressure part and one or more low-pressure parts, it is conventional practice to axially secure the outer casing of the low-pressure turbine relative to the entire turboset. On account of the thermal expansions occurring during starting and stopping and during load changes, the bearing blocks, a further low-pressure part which may be present, the intermediate- and high-pressure part, and the generator must be able to expand freely in the longitudinal direction starting from the secured low-pressure part.

EP-A1-05 75 642 discloses a double-casing low-pressure steam turbine which mainly comprises an inner casing with the turbine rotor as well as an outer casing with an exhaust-steam space. The outer casing is split, i.e. it has a top and bottom part. The bottom part of the outer casing is designed as empty steel formwork and is arranged in a recess of the concrete foundation. The condenser adjoins the bottom end of the casing bottom part. Both the dividing plane of the two casing parts and the condenser connection are integral parts of the foundation. The bearing points for accommodating the rotor lie above the dividing plane, i.e. above the foundation table.

Supporting such a low-pressure steam turbine on a concrete foundation is relatively complicated and expensive. In addition, high foundation loading occurs as a result of the vacuum draft or the condenser weight.

EP-A1-03 84 200 discloses a steam condenser in a set-up at ground level next to the steam turbine, which steam condenser is connected to the steam turbine via an exhaust-steam hood. The steam is discharged above the foundation. Thus, in contrast to the underfloor arrangement of the condenser, both the overall height of the machine house and that of the turbine foundation may be greatly reduced. The condenser is supported separately from the steam turbine on simple sliding shoes, as a result of which the loading on the concrete foundation is reduced.

A disadvantage with this solution, however, is that a very large exhaust-steam hood is required for the low-pressure steam turbine in order to cope with the volumetric flow of the exhaust steam, a factor which necessitates a relatively large construction space. Thus both the cost of manufacture and the effort required to assemble the steam turbine increase. Furthermore, the steam flow has to be deflected from the bottom part of the casing into the exhaust-steam hood, which results in a pressure loss and thus a lower efficiency. In addition, relatively large horizontal forces act on the exhaust-steam hood of the low-pressure turbine, which horizontal forces have to be transmitted to the foundation in a suitable manner. Consequently, the cost of manufacture of the steam turbine again increases.

SUMMARY OF THE INVENTION

Accordingly, one object of the invention, in attempting to avoid all these disadvantages, is to increase the efficiency of a low-pressure steam turbine connected to a condenser and to reduce its cost of manufacture.

This is achieved according to the invention in an apparatus in which the dividing plane of the top and bottom part of the outer casing lies at the level of the axis of the turbine rotor, and the concrete foundation reaches up to the dividing plane. Both the bottom part of the outer casing and the bearing points of the turbine rotor are secured in the concrete foundation. The outer casing is designed to be open at least on one side, the opening(s) being arranged at right angles to and horizontally to the axis of the turbine rotor. One condenser is attached in the case of only one lateral opening in the outer casing and one condenser each is attached in the case of two lateral openings.

If there is only one condenser, the top part of the outer casing consists of an assembly hood and a frame part connected to the bottom part and the condenser by cohesive bonding, such as by welding, brazing, or adhesive bonding, or in a non-positive manner, that is by a friction gripping means, such as screws or bolts. The assembly hood is connected to both the bottom part of the outer casing and the frame part in a non-positive or positive-locking manner, the latter being arranged between the condenser and assembly hood. In the case of two condensers, a frame part is formed on both sides in each case.

Since the concrete foundation reaches up to the level of the axis of the turbine rotor or up to the dividing plane of the top and bottom part of the outer casing, both the bottom part and the bearing points of the turbine rotor are cast with the foundation when it is being made on site. In this way, the concrete foundation itself can absorb the operating forces of the low-pressure steam turbine and of the condenser(s) connected to it and can thus be optimally utilized.

When the outer casing is designed to be open on one side, the condenser fastened at the side of and at the same level as the low-pressure steam turbine may be connected to the exhaust-steam space in the region of the entire opening. If the outer casing is designed to be open on both sides, both condensers are connected to the exhaust-steam space in the same manner. In both variants, the steam flow passes into the condenser by a direct route and without having to be deflected again. Thus the pressure loss is reduced and the efficiency is improved compared with the prior art.

Each frame part connected to the condenser and the bottom part of the outer casing by cohesive bonding or in a friction gripping manner serves to stiffen the top part of the outer casing. On account of the non-positive connection between the hood, closing off the exhaust-steam space at the top, and the frame part and the bottom part of the outer casing, the hood may be constructed as an assembly hood. It is thus of substantially lighter and simpler design than the exhaust-steam hoods of the prior art. In addition, the assembly hood ensures better accessibility to the inner components of the low-pressure steam turbine. A welded steel-plate construction of the assembly hood is also possible. The cost of manufacture of the steam turbine and the effort required to assemble it are thereby further reduced.

On account of the design according to the invention of the low-pressure steam turbine, the bottom part of the outer casing and the bearing points are integrated in the concrete foundation when it is being constructed. At the same time, the frame part or frame parts of the top part are connected to the bottom part of the outer casing by cohesive bonding or in a friction gripping manner. Only the inner casing having the turbine rotor and the assembly hood are constructed as loose parts. During final assembly of the low-pressure steam turbine, the preassembled compact unit consisting of foundation, outer casing (bottom part and frame part(s)) and bearing points are finally completed merely by the components already mentioned. This results in very little assembly effort and a low cost of manufacture.

It is advantageous if a plurality of, preferably vertical, outer formwork ribs are arranged on the bottom part of the outer casing. This results in an intimate connection to the bottom part when the concrete foundation is being constructed, so that the forces which occur can be dissipated in an even better manner via the foundation.

Of course, two or more low-pressure steam turbines of analogous design may be connected to one another. The bearing points of high-pressure or intermediate-pressure steam turbines connected to the low-pressure steam turbine to form a turbo-group may be designed in the same way as the bearing points of the low-pressure steam turbine.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
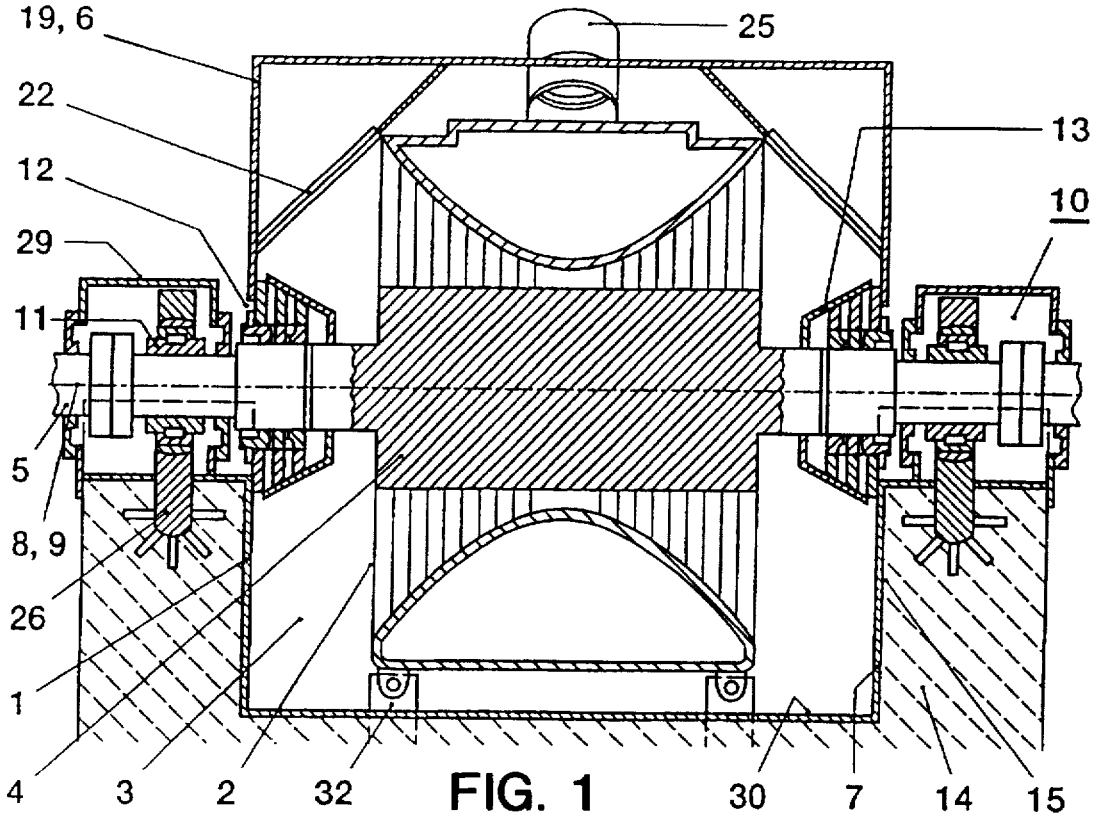
FIG. 1 shows a longitudinal section of a double-flow low-pressure sectional steam turbine.

Only the elements essential for understanding the invention are shown. Elements of the plant which are not shown are, for example, the cooling-water injection pipes arranged in the top part of the outer casing.

DESCRIPTION OF THE PREFERRED EMBODIMENTS

Referring now to the drawings, wherein like reference numerals designate identical or corresponding parts throughout the several views, the low-pressure steam turbine set up at ground level is of double-casing design, i.e. its casing essentially comprises an outer casing 1 and an inner casing 2 which are arranged separately from one another. Consequently, the inertia and kinetic forces of the outer casing 1 cannot act on the inner casing 2 and vice versa.

An exhaust-steam space 3 is formed between outer and inner casing 1, 2. A turbine rotor 4 is arranged in the inner casing 2 and is connected to a shaft end part 5 in a rotationally locked manner. The two-piece outer casing 1 consists of a top and bottom part 6, 7, the dividing plane 8 of which lies at the level of the axis 9 of the turbine rotor 4. A bearing point 10 with corresponding supporting bearings 11 for the turbine rotor 4 is formed on either side of the turbine rotor 4 (FIG. 1). The outer casing 1 has a casing lead-through 12 on either side for the shaft end part 5 of the turbine rotor 4. An encapsulated shaft seal 13 is arranged on the shaft end part 5 in the region of each casing lead-through 12, which shaft seal seals off the exhaust-steam space 3 to the outside.

The low-pressure steam turbine is accommodated by a concrete foundation 14, which has a recess 15 for this purpose. The bottom part 7 of the outer casing 1 is designed as steel formwork of the concrete foundation 14 extending up to the dividing plane 8 of the outer casing 1. Thus both the bottom part 7 of the outer casing 1 and the bearing points 10 of the turbine rotor 4 are secured in the concrete foundation 14 (FIG. 1, FIG. 2).

A condenser 16 is arranged next to the outer casing 1 of the low-pressure steam turbine and is connected to the exhaust-steam space 3. Like the steam turbine, the condenser 16 is set up at ground level. To this end, the outer casing 1 of the low-pressure steam turbine is designed to be open on one side at right angles to and horizontally to the axis 9 of the turbine rotor 4. The condenser 16 adjoins the opening 17 of the outer casing 1 (FIG. 2). In plan view, the bottom part 7 of the outer casing 1 has a U-shape, which is open toward the condenser 16 (FIG. 3). A plurality of vertical, outer formwork ribs 18 are arranged on the bottom part 7, as a result of which a sturdy connection to the concrete foundation 14 is obtained. The formwork ribs 18 may of course also be oriented in another manner.

The top part 6 of the outer casing 1 is formed by an assembly hood 19 and by a frame part 20 connected to the bottom part 7 and the condenser by cohesive bonding. The assembly hood 19 completely closes the exhaust-steam space 3 above the dividing plane 8. It consists of a welded steel-plate construction having two end walls 21 and stiffeners 22 as well as of a vertical and a horizontal connecting flange 23, 24. Fastened in the assembly hood 19 is a live-steam connection piece 25 via which the steam is fed from the intermediate-pressure steam turbine (not shown).

Figure 2:
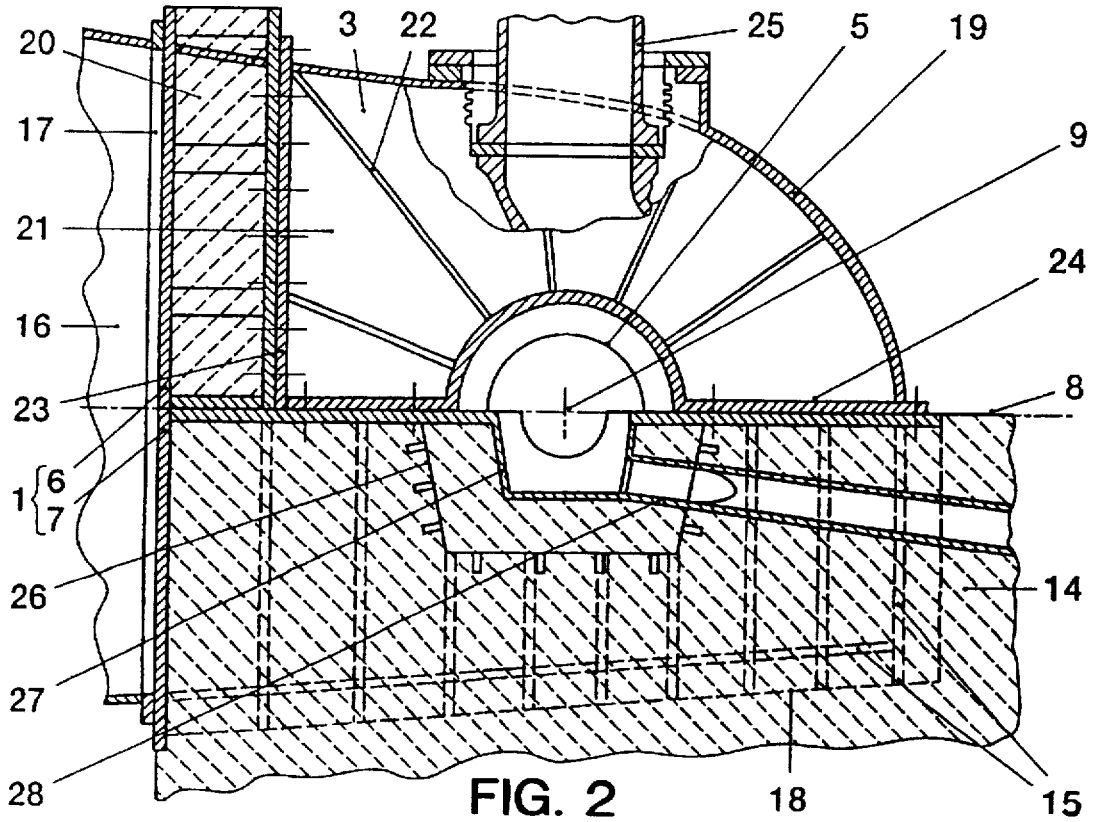
FIG. 2 shows a cross-section through the steam turbine in accordance with FIG. 1.
Figure 3:
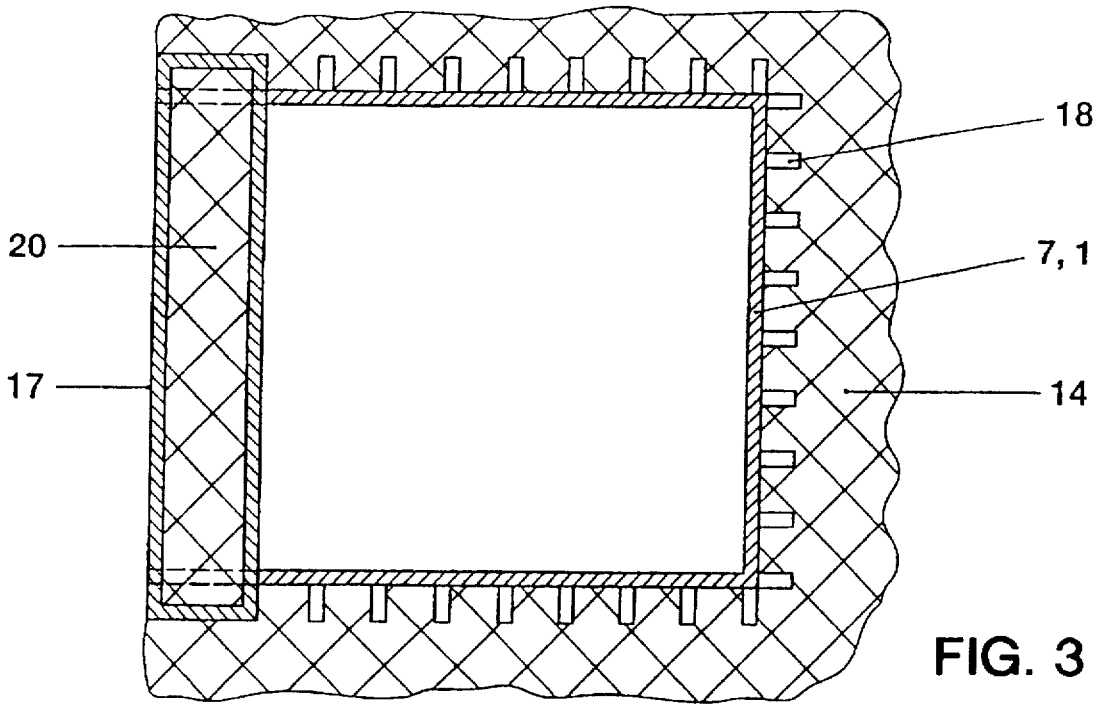
FIG. 3 shows a sectional view of the preassembled unit consisting of foundation and outer-casing bottom part.

The frame part 20 is of stirrup-shaped design and is welded to the condenser 16 and to the bottom part 7 of the outer casing 1 (FIG. 2). It is at least partly hollow in its interior and is cast simultaneously with the bottom part 7 of the outer casing 1 when the concrete foundation 14 is being made. It may of course also simply be welded. A friction gripping connection by means of screws is likewise possible. The frame part 20 carries the assembly hood 19 and is a connecting link between the latter and the condenser 16. To this end, it is screwed to the assembly hood 19 via the vertical connecting flange 23. However, another friction gripping or a positive-locking connection, that is, an interlocking connection, may also be selected. To seal off the assembly hood 19 screwed to the bottom part 7 of the outer casing 1, a sealing strip (not shown) is welded to the horizontal connecting flange 24. A further sealing strip is arranged between the vertical connecting flange 23 and the frame part 20. Other suitable sealing means may of course also be used.

A bearing saddle 26 is in each case embedded into the concrete foundation 14 at the bearing points 10 and anchored to the latter. The bearing saddle 26 accommodates an oil pan 27 which is connected to an oil-drain line 28 integrated in the concrete foundation 14. The supporting bearing 11 is arranged in the bearing saddle 26 and is secured against vertical movements (FIG. 1). The bearing point 10 is covered by a housing cover 29.

The exact orientation of the turbine rotor 4 relative to the adjoining neighboring rotors of other sectional turbines or to the generator is effected by means of an adjusting device (not shown).

Figure 4:
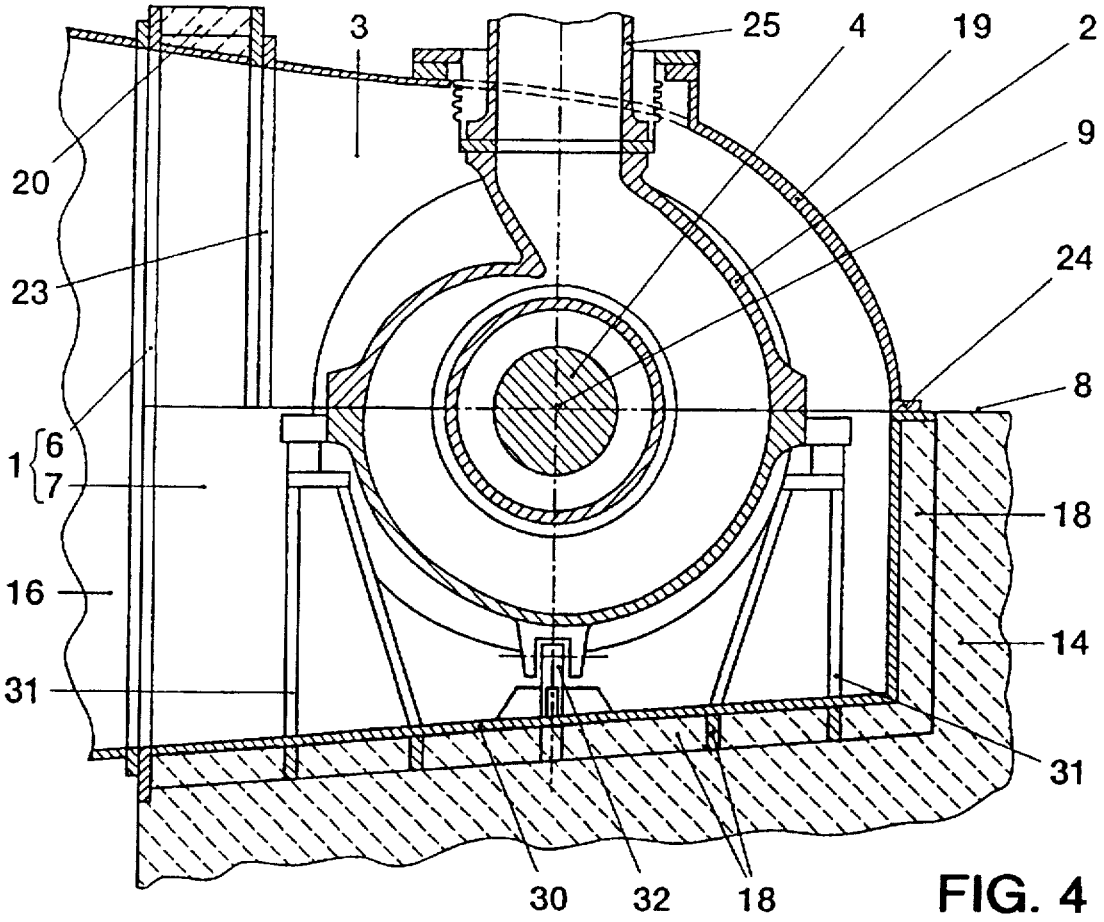
FIG. 4 shows a cross-section through the inlet part of the steam turbine.

In the region of the base 30 of the recess 15, the inner casing 2 of the low-pressure steam turbine is mounted on four stanchions 31 and is guided in the axial direction via two guides 32. The guides 32 are connected to the concrete foundation 14 and are adjustable transversely to the axis 9 of the turbine rotor 4 (FIG. 4).

Both the bottom part 7 of the outer casing 1 and the bearing points 10 of the turbine rotor 4 are integrated when the concrete foundation 14 is being constructed. The concrete foundation 14 is formed right up to the level of the dividing plane 8 of the bottom and top part 7, 6 of the outer casing 1. After the condenser 16 is mounted, the frame part 20 likewise filled with concrete is welded to the condenser 16 and the bottom part 7 of the outer casing 1. During final assembly of the low-pressure steam turbine, this preassembled, compact unit is completed merely by the inner casing 2 with the turbine rotor 4 and by the assembly hood 19. It is thereby possible also to preassemble the inner casing 2 and the turbine rotor 4, to transport them together and finally to insert them together into the prepared concrete foundation 14. This results in very little assembly effort and a low cost of manufacture.

During operation of the low-pressure steam turbine, the steam flow is directed out of the intermediate-pressure steam turbine (not shown) via the live-steam connection piece 25 into the inner casing 2. It drives the turbine rotor 4 and in the process is expanded to the exhaust-steam pressure. Finally, the steam passes via the exhaust-steam space 3 and the opening 17 in the outer casing 1 by a direct route, i.e. without having to be deflected again, into the condenser 16 and is condensed there.

In a second exemplary embodiment, two condensers 16 are connected to the low-pressure steam turbine. To this end, its outer casing 1 has on either side a lateral opening 17 arranged at right angles to and horizontally to the axis 9 of the turbine rotor 4. A condenser 16 is attached to each opening 17 and is connected (not shown) in each case to a frame part 20 and the bottom part 7 of the outer casing 1. All other components are essentially designed and arranged in an analogous manner to the exemplary embodiment shown.

Figure 5:
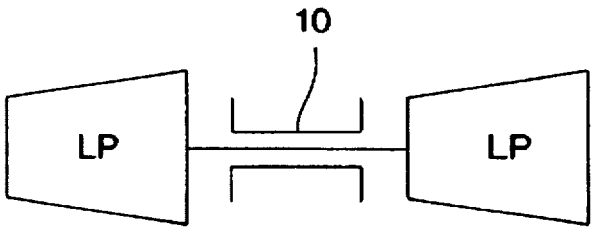
FIG. 5 is a schematic of two low pressure steam turbines connected by a shaft supported by bearing 10.

The invention is of course not restricted to the exemplary embodiment shown and described having one low-pressure steam turbine. Two or more low-pressure steam turbines of analogous design may likewise be connected to one another as shown in FIG. 5.

Figure 6:
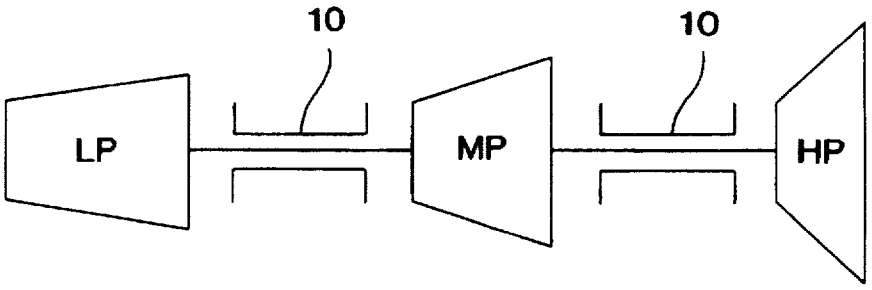
FIG. 6 is a schematic of an apparatus including a low pressure turbine, and alternately an intermediate pressure or high pressure turbine connected by a shaft supported by bearings 10.

The bearing points of high-pressure or intermediate-pressure steam turbines connected to the low-pressure steam turbine to form a turbo-group may also be designed in the same way as the bearing points 10 of the low-pressure steam turbine as shown in FIG. 6.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A low-pressure steam turbine comprising:

an inner casing, a turbine rotor mounted in the inner casing, an outer casing with an exhaust-steam space enclosing the inner casing, the outer casing having a top and bottom part, a concrete foundation with a recess for accommodating the bottom part of the outer casing, the bottom part being designed as steel formwork of the concrete foundation, bearing points located on opposite sides of the recess and having supporting bearings for the turbine rotor, a condenser connected to the outer casing and arranged at a side of the outer casing, wherein:

a dividing plane between the top and bottom part of the outer casing lies on an axis of the turbine rotor and the concrete foundation extends vertically to the dividing plane, the bottom part of the outer casing and the bearing points of the turbine rotor are secured in the concrete foundation, the outer casing having a lateral opening at least on one side perpendicular to and horizontal to the axis of the turbine rotor and connected to the condenser at said at least one lateral opening in the outer casing, the top part of the outer casing includes an assembly hood and, for said at least one opening, a frame part is connected to the condenser and the bottom part by one of a cohesive bonding and a friction gripping fastening manner, and wherein, the assembly hood is connected to the bottom part of the outer casing and to said frame part in one of a friction gripping fastening and an interlocking fastening manner and said frame part is arranged between said condenser and the assembly hood.

2. The low-pressure steam turbine as claimed in claim 1, wherein the assembly hood is made of steel plate and has stiffeners.

3. The low-pressure steam turbine as claimed in claim 1, wherein a plurality of vertical, outer formwork ribs are arranged on the bottom part of the outer casing.

4. The low-pressure steam turbine as claimed in claim 3, wherein a bearing saddle is embedded in the concrete foundation at each of the bearing points, and each bearing saddle accommodates an oil pan which is connected to an oil-drain line integrated in the concrete foundation.

5. The low-pressure steam turbine as claimed in claim 1, wherein at least two low-pressure steam turbines of analogous design are connected to one another.

6. The low-pressure steam turbine as claimed in claim 1, wherein bearing points of a high-pressure steam turbine or an intermediate-pressure steam turbine of analogous design are connected to the bearing points of the low-pressure steam turbine.

* * * * *